US006189188B1

(12) United States Patent
O'Hare

(10) Patent No.: US 6,189,188 B1
(45) Date of Patent: Feb. 20, 2001

(54) MEMORIALIZATION OF HUMAN CREMAIN IN ARTIFICIAL REEF

(76) Inventor: Christopher F. O'Hare, 22 Harbour Dr. South, Ocean Ridge, FL (US) 33435

( * ) Notice: Under 35 U.S.C. 154(b), the term of this patent shall be extended for 0 days.

(21) Appl. No.: 09/270,248

(22) Filed: Mar. 15, 1999

(51) Int. Cl.[7] ..... A61G 17/00
(52) U.S. Cl. ..... 27/1; 428/542.4
(58) Field of Search ..... 27/1, 35; 405/21, 405/22, 24, 33; 119/221; 52/133, 134, 136; 428/542.4

(56) References Cited

U.S. PATENT DOCUMENTS

| | | | |
|---|---|---|---|
| 1,640,680 | | 8/1927 | Vanderlaan . |
| 3,732,602 | | 5/1973 | Vigh . |
| 4,840,516 | | 6/1989 | Rambo . |
| 5,016,330 | | 5/1991 | Botsch . |
| 5,122,015 | | 6/1992 | Shen . |
| 5,127,112 | | 7/1992 | Brock . |
| 5,246,307 | | 9/1993 | Rauch . |
| 5,287,603 | * | 2/1994 | Schorman ..... 27/35 X |
| 5,393,253 | * | 2/1995 | Humble et al. ..... 27/1 X |
| 5,740,637 | * | 4/1998 | Snow ..... 27/1 X |
| 5,803,660 | | 9/1998 | Warren et al. . |
| 6,041,483 | * | 3/2000 | Burch ..... 27/1 |

FOREIGN PATENT DOCUMENTS

| | | |
|---|---|---|
| 9214433 | 2/1992 | (WO) . |

* cited by examiner

*Primary Examiner*—Terry Lee Melius
*Assistant Examiner*—William L. Miller
(74) *Attorney, Agent, or Firm*—BakerBotts, LLP

(57) ABSTRACT

An artificial reef is assembled from modular units having mating projections and recesses and incorporating human cremain to provide a memorial for deceased persons in a marine environment. In one embodiment the human cremain is encapsulated in cavities within the module. In another embodiment, the human cremain is incorporated in a plaque mounted in an opening in the surface of the module.

15 Claims, 3 Drawing Sheets

MEMORIALIZATION OF HUMAN CREMAIN IN ARTIFICIAL REEF

BACKGROUND OF THE INVENTION

This invention relates to artificial reefs in which human cremain is incorporated as a memorial to the deceased.

Memorialization of deceased human beings is a significant part of our cultural heritage. Burial of intact human remains in the ground or in a vault accompanied by a stone monument or bronze inscription panel has generally been considered the most frequently used method of interment and memorialization. Recently, cremation of deceased human remains has become an acceptable method of final disposition which has steadily increased in popularity because of the increasing cost of conventional funerals, limitations on cemetery space in urban areas and changes in cultural attitudes towards cremation.

Typically, cremated remains (cremain) are memorialized by interment in a decorative container which is kept in a private residence or a columbarium. Alternatively, the cremain may be ceremonially scattered in a preferred location such as a garden or a body of water. The most frequent choice for such scattering is a large body of water such as an ocean. The limited benefit of such disposal of cremain is the memory of a satisfactory ceremony and the minute addition of certain minerals to the body of the water. This benefit is greatly diminished if the ceremony is disrupted by inclement weather, rough seas or excessive wind. Moreover, there is no permanent object containing the cremain which can be recognized as a memorial to the deceased.

The perpetuation of cremain in various objects is known in the art. For example, the Vanderlaan Patent No. 1,640,680 discloses a method of perpetuating human remains in the form of ceramic tiles made with cremain and formed into plaques or other objects which are then incorporated into specific objects to which the deceased devoted his life, for example bridges, tunnels, dams and the like, or in a house of worship or in a specific outdoor location frequented by the deceased person. The patent to Botsch, No. 5,016,320, discloses the incorporation of cremain into a molded object representing or resembling the deceased, particularly a deceased animal, or something for which a deceased person was particularly noted, such as a replica of the deceased's house, automobile, or the like.

The patent to Brock, No, 5,127,112, discloses a watertight capsule for underwater burial in which human remains are preserved, whereas the Vigh Patent No. 3,732,602, discloses a submersible crematory urn constructed of degradable material so as to dissolve in the water.

Artificial reefs for the preservation of marine ecosystems are known. For example, the patents to Rambo No. 4,840,516, Shen 5,122,015 and Warren et al. No. 5,803,660, disclose reef structures made of interlocking modules and the Rauch Patent No. 5,246,307 discloses a module to be used in submerged breakwater and a barrier reef module. None of the prior art, however, discloses or provides any way of maintaining a memorial to a deceased person who had a special interest in the marine ecosystem and the preservation thereof.

SUMMARY OF THE INVENTION

Accordingly, it is an object of the present invention to provide a method and arrangement for memorialization of human cremain in artificial reefs which overcomes disadvantages of the prior art.

Another object of the invention is to provide an underwater memorial incorporating human cremain which is resistant to the deteriorating effect of elements that are present in the marine environment so as to prevent accidental or deliberate removal of the cremain and to resist displacement of the memorial by waves or currents.

A further object of the invention is to provide an article containing human cremain which forms an interlocking shape or assembly with similar articles into interlocking modules so as to provide increased resistance to displacement by waves and currents in a marine environment.

These and other objects of the invention are attained by providing a module formed of a composite cementious mixture which contains human cremain and which has an external surface arranged to form a cooperative interface with similar modules. In accordance with one aspect of the invention, a plurality of such modules with cooperative interlocking linking surfaces is assembled into an artificial reef structure. In one form of module, human cremain is combined with a proportionate amount of a cementious mixture and encapsulated in pockets in a shaped block of aggregate cementious material, the encapsulated cremain being totally surrounded by the module material so that no part of the cremain is exposed to the potentially deteriorating action of sea water. For identification purposes, a plaque containing the identification of the individual whose cremain is incorporated into the module and which may also contain cremain may be affixed to the outer surface of the module in a permanent manner.

In order to form an artificial reef resistant to wave and current action from an assembly of such modules, each module is preferably formed with at least one projection on one surface and has a corresponding recess to receive a similar projection of another module when a plurality of modules are assembled into an artificial reef.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
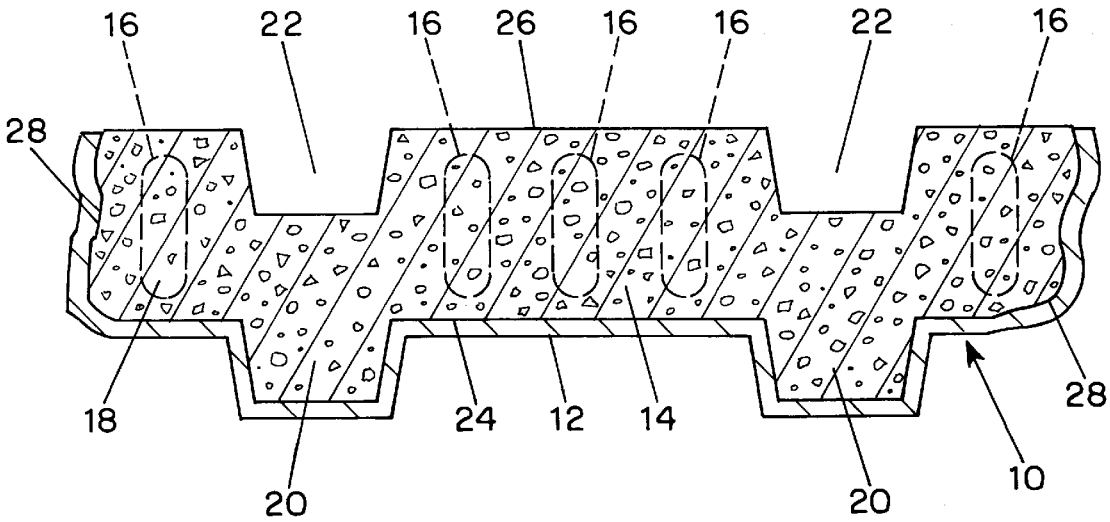
FIG. 1 is a cross-sectional view illustrating the preparation of a representative embodiment of a module for an artificial reef in accordance with the invention.
Figure 2:
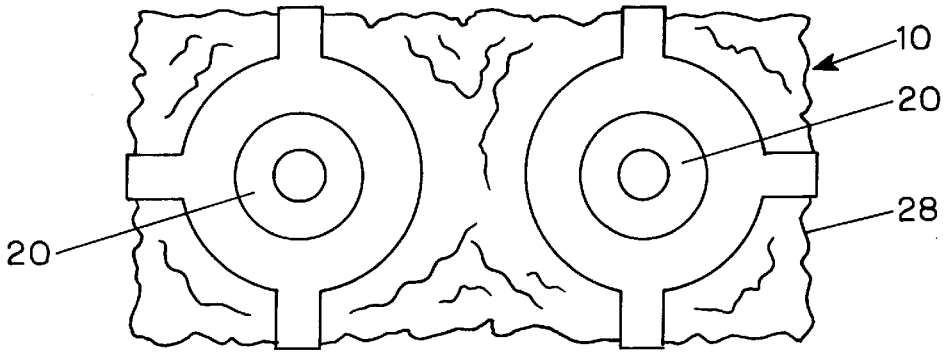
FIG. 2 is a plan view of the module shown in FIG. 1.

In the typical embodiment of the invention shown upside-down in FIG. 1 and from the top in FIG. 2, a module 10 for an artificial reef consists of a cementious mixture of portland cement, graded limestone aggregates, silica fume, water and commercially available chemical admixtures to enhance resistance to deterioration in a marine environment. The cementious mixture which has been sufficiently mixed to insure complete hydration when cured is inserted in a mold 12 so as to provide a matrix 14 and, prior to curing, a slurry of cremain-containing cementious material 18 is inserted or injected into the matrix so as to be completely surrounded by the material of the matrix 14 to produce encapsulated portions 16 which will be protected by matrix 14 from exposure to the environment.

The slurry material 18 which is inserted to produce the encapsulated portions 16 in the matrix 14 may have the same or similar composition as the matrix material, but need not include chemical admixtures to enhance resistance to deterioration in a marine environment since it is entirely enclosed by the matrix material.

The mold 12 may have any shape designed to produce a desired external configuration of the module 10, but preferably includes portions formed as frustoconical projections 20 and corresponding recesses 22 in the opposed major surfaces 24 and 26, respectively, of the module. In addition, the mold 12 preferably has an irregular surface 28 in other regions so as to produce a stone-like texture to the surface, simulating a natural object and providing a texture and density of the exterior surface which enhances the module's suitability as a substrate for colonization by benthic organisms, thereby promoting proliferation of marine plant and animal life. Each module 10 is preferably large enough, for example two feet by four feet by eight feet, and heavy enough, weighting, for example, at least 1,500 pounds, to resist displacement by waves and currents and to remain in a stable position on the ocean floor.

Figure 3:
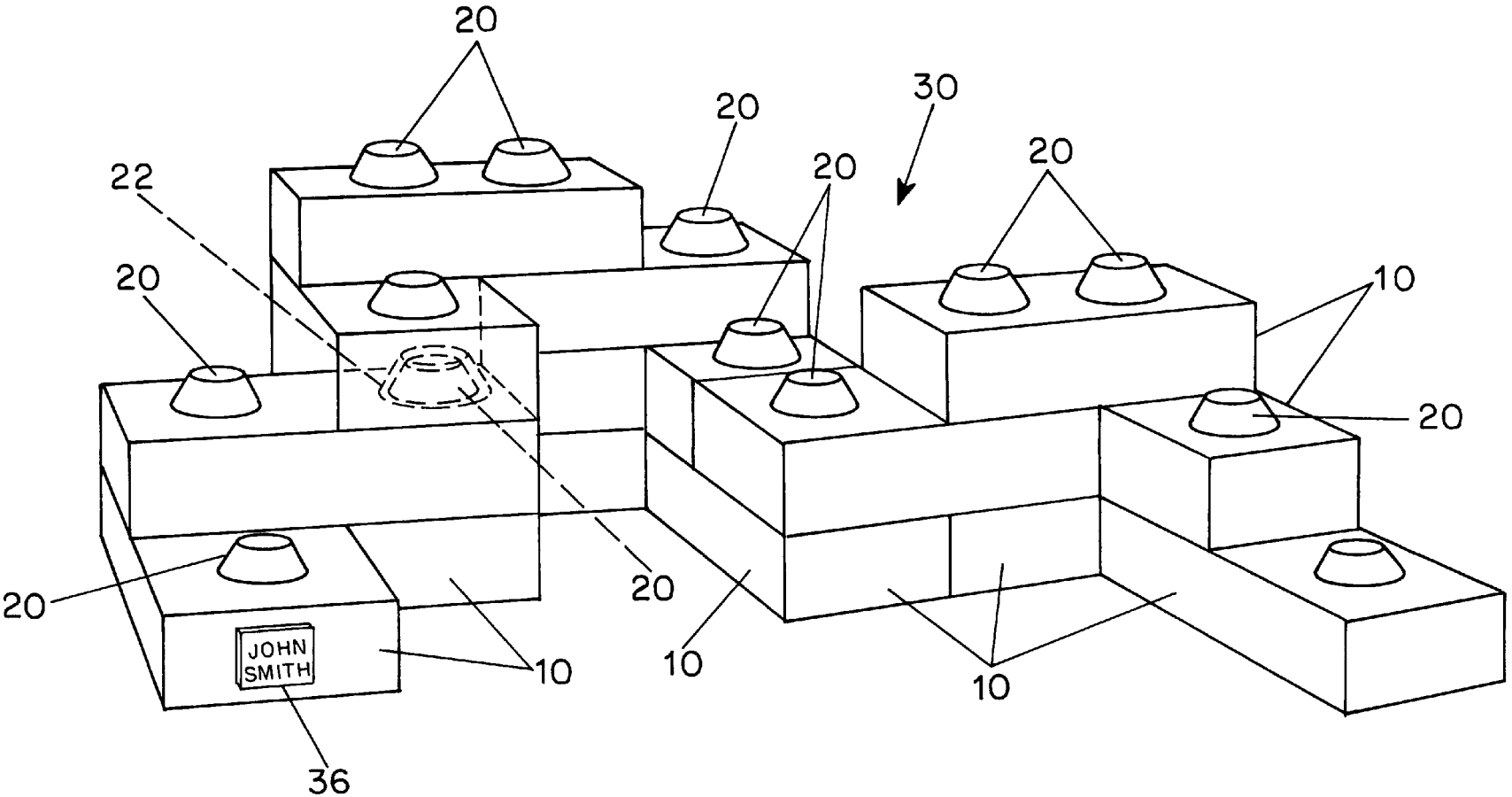
FIG. 3 is a perspective view illustrating another representative embodiment of a module in accordance with the invention.

FIG. 3 illustrates schematically an assemblage of interlocking modules 10 made in accordance with the invention to provide an artificial reef 30. By assembling the modules 10 so that a frustoconical projection 20 in one module engages a recess 22 in an adjacent module, the artificial reef is resistant to undesired displacement by underwater currents and wave action, thereby assuring a stable habitat for fish and other marine animals.

Figure 4:
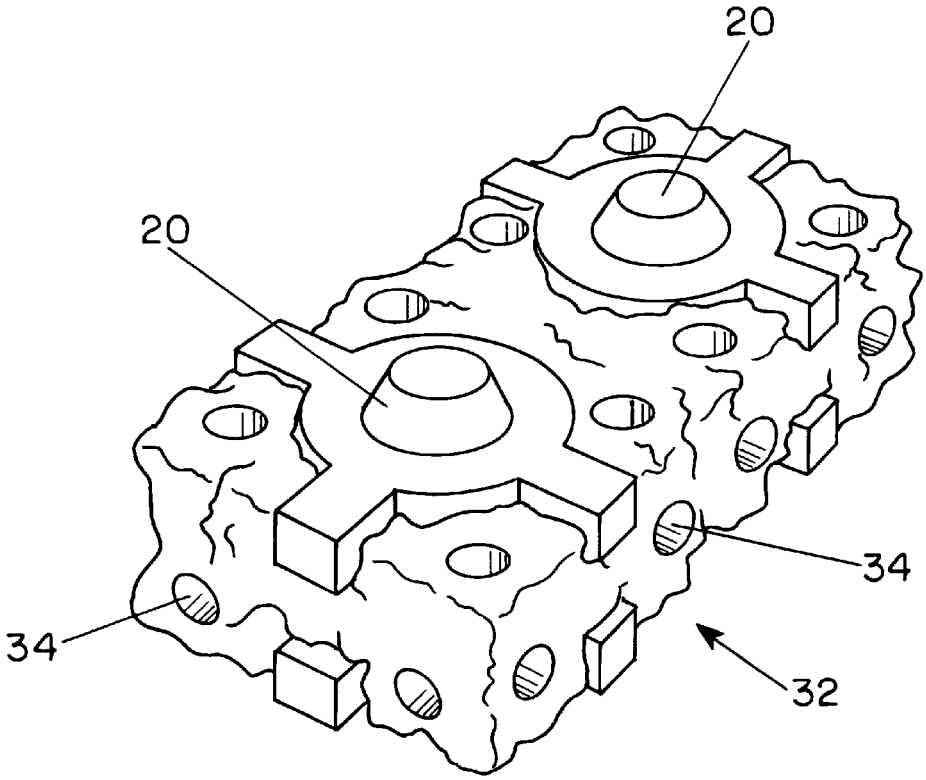
FIG. 4 is a fragmentary sectional view of the module shown in FIG. 3.
Figure 5:
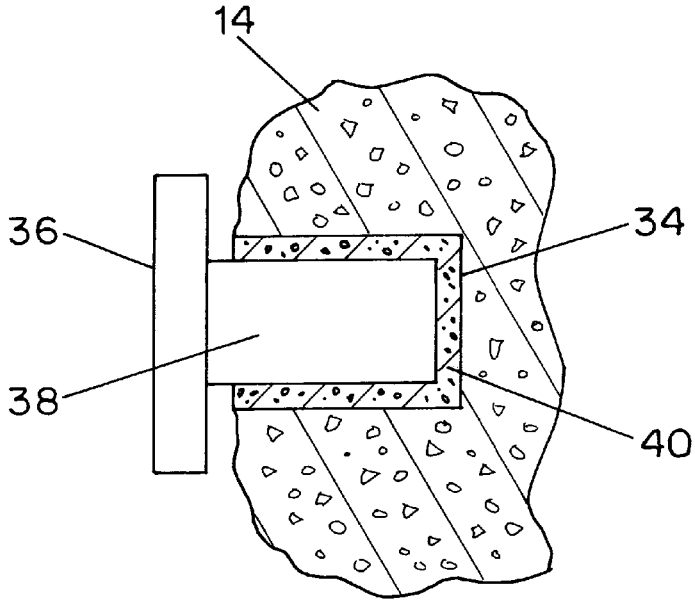
FIG. 5 is a schematic diagram illustrating an assembly of modules for forming an artificial reef in accordance with the invention.

In the embodiment shown in FIGS. 4 and 5, a module 32 is formed in a manner similar to that of the module 10, but has a plurality of mounting holes 34 in its exposed surfaces in which memorial plaques 36 may be mounted in the manner shown in FIG. 5. As shown in FIG. 5, the memorial plaques 36 have projections 38 which are secured in the holes 34 by cement 40 and, as indicated in one of the modules in FIG. 3, each plaque contains the identification of a deceased person whose cremain is incorporated in the module. The plaque 36 is made of cementious material similar to that of the matrix 14 and, if desired, the cremain of the memorialized person may also be incorporated into the material of the plaque.

In accordance with the invention, therefore, a module is provided which may be incorporated into a stable artificial reef containing a permanent specimen of individual human cremain in a manner resistant to deteriorating action by a marine environment so as to provide a memorial which is particularly appropriate for a person who has dedicated his life to the preservation of the marine ecosystem.

Although the invention has been described herein with reference to specific embodiments, any modifications and variations therein will readily occur to those skilled in the art. Accordingly, all such variations and modifications are included within the intended scope of the invention.

I claim:

1. A method for preserving human cremain in a marine environment comprising forming a module made of cementitious material which resists deterioration in the marine environment, inserting a cementitious mixture containing the human cremain into the material of the module and depositing the module on the floor of a body of water.

2. A method according to claim 1 wherein the mixture containing human cremain is inserted into the cementious material before solidification thereof so as to encapsulate the mixture containing human cremain.

3. A method according to claim 1 wherein the mixture containing human cremain is inserted into an opening in a surface of the module.

4. A method according to claim 3 wherein the mixture containing human cremain is in the form of a plaque mounted in the opening in the module.

5. A method according to claim 4 including providing identifying information on the surface of the plaque relating to a person whose cremain is incorporated into the plaque.

6. A method according to claim 1 including forming an irregular surface on the module to provide a surface texture resembling a texture of stone.

7. A method according to claim 1 including forming at least one projection and one recess on surfaces of the module and assembling the module with a plurality of similar modules so that projections of some modules are received in recesses of other modules.

8. A modular unit comprising a block of cementious material and at least one cavity therein containing a mixture comprising cementitious material and human cremain so as to be encapsulated within the block of cementitious material.

9. A modular unit according to claim 8 including a portion having a predetermined shape projecting from one surface of the module and a recess having a corresponding predetermined shape in another surface of the module, for permitting engagement of the projection and the recess with a corresponding recess and a corresponding projection, respectively, of another module.

10. An artificial reef comprising a plurality of modules made of cementitious material, at least some of the modules containing a mixture comprising cementitious material incorporating human cremain, the modules being assembled to form the artificial reef.

11. An artificial reef according to claim 10 wherein each of the modules includes a projecting portion having a predetermined shape and a recess having a corresponding predetermined shape and in which the projecting portion of one of the modules is received in the corresponding recess of the adjacent module to form an interlocking structure.

12. An artificial reef according to claim 10 wherein at least some of the modules have internal cavities containing the mixture comprising human cremain.

13. An artificial reef according to claim 10 wherein at least some of the modules have a hole in a surface in which an identifying plaque is mounted.

14. An artificial reef according to claim 13 wherein the plaque contains identification of the deceased whose cremain is incorporated in the plaque.

15. An artificial reef according to claim 10 wherein the surface of the module is irregular to provide a texture resembling a texture of stone.

* * * * *